US009289355B2

(12) United States Patent
Agren

(10) Patent No.: US 9,289,355 B2
(45) **Date of Patent: *Mar. 22, 2016**

(54) DILUTION KIT AND METHOD

(71) Applicant: SAPA-IP, LLC, Tempe, AZ (US)

(72) Inventor: Stuart H. Agren, Mesa, AZ (US)

(73) Assignee: SAPA-IP, LLC, Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/698,509

(22) Filed: Apr. 28, 2015

(65) Prior Publication Data

US 2015/0231033 A1 Aug. 20, 2015

Related U.S. Application Data

(63) Continuation-in-part of application No. 14/512,957, filed on Oct. 13, 2014, which is a continuation of application No. 12/418,240, filed on Apr. 3, 2009, now Pat. No. 8,858,063.

(51) Int. Cl.

| | |
|---|---|
| ***B01F 15/02*** | (2006.01) |
| ***B01F 3/00*** | (2006.01) |
| ***A61J 1/16*** | (2006.01) |
| ***A61J 1/06*** | (2006.01) |
| ***B65D 25/10*** | (2006.01) |
| ***B65B 3/00*** | (2006.01) |

(52) U.S. Cl.

CPC .... *A61J 1/16* (2013.01); *A61J 1/06* (2013.01); *B65B 3/00* (2013.01); *B65D 25/108* (2013.01)

(58) Field of Classification Search

CPC ..... A45C 5/00; A45C 5/04; A45C 11/00; A45C 11/008; A45C 11/24; A45C 13/005; A45C 2200/20; A45C 13/008; A45C 13/02; A45C 2013/026; A45C 13/10; A45C 13/1076; A45C 13/1084; A45C 15/00; A45C 2200/15; B65D 71/00; B65D 77/00; B65D 83/00; B65D 85/00; B65D 85/70; B65D 85/72; B65D 25/00; B01F 5/04; B01F 3/00; B01F 3/08; B01F 13/0288; B01F 3/0803; B01F 3/0861; B01F 3/0865; B01F 3/088; B01F 2003/0884; B01F 2003/0896

See application file for complete search history.

(56) References Cited

U.S. PATENT DOCUMENTS

| | | | |
|---|---|---|---|
| 1,986,403 | A | 1/1935 | Lehmkuhl |
| 3,043,616 | A | 7/1962 | Magnuson |
| 3,367,483 | A | 2/1968 | Studen |

(Continued)

FOREIGN PATENT DOCUMENTS

| | | |
|---|---|---|
| EP | 0397607 | 4/1989 |

*Primary Examiner* — Christopher Schatz
*Assistant Examiner* — Matthew Hoover
(74) *Attorney, Agent, or Firm* — Jackson White, PC; Steven J. Laureanti

(57) ABSTRACT

A method of diluting concentrated solutions used to treat allergic symptoms is disclosed. The method includes placing a predetermined amount of one of a diluent, a concentrated solution, and a combination thereof into an empty vial of a plurality of vials including an empty maintenance vial, a diluent vial, an intermediate vial and an empty start vial. The method further includes removing an amount of concentrated solution and placing the concentrated solution into an empty maintenance vial, removing an amount of diluent and placing a portion of the diluent from the diluent vial into each of the intermediate vial and the start vial, removing an amount of concentrated solution and placing the concentrated solution from the maintenance vial into the intermediate vial. The method still further includes removing an amount of solution from the intermediate vial and placing the solution from the intermediate vial into the start vial.

5 Claims, 4 Drawing Sheets

(56) References Cited

U.S. PATENT DOCUMENTS

| | | | |
|---|---|---|---|
| 3,857,423 | A | 12/1974 | Ronca, Jr. |
| 4,106,597 | A | 8/1978 | Shook et al. |
| 5,570,780 | A | 11/1996 | Miller |
| 6,467,619 | B1 | 10/2002 | Leen et al. |
| 6,779,566 | B2 | 8/2004 | Engel |
| 6,779,665 | B2 | 8/2004 | Bolanos |
| 6,929,778 | B2 | 8/2005 | Nunes et al. |
| 7,385,507 | B2 | 6/2008 | Simpson et al. |

DILUTION KIT AND METHOD

CROSS-REFERENCE TO RELATED APPLICATIONS

This application is a continuation-in-part of U.S. patent application Ser. No. 14/512,957, filed on Oct. 13, 2014, entitled "Dilution Kit & Method" which is a continuation of U.S. patent application Ser. No. 12/418,240, filed on Apr. 3, 2009, entitled "Dilution Kit & Method", now U.S. Pat. No. 8,858,063. U.S. patent application Ser. No. 14/512,957 and U.S. Pat. No. 8,858,063 are assigned to the assignee of the present application. The subject matter disclosed in U.S. patent application Ser. No. 14/512,957 and U.S. Pat. No. 8,858,063 are hereby incorporated by reference into the present disclosure as if fully set forth herein.

BACKGROUND

1. Technical Field

This document relates to devices and methods for diluting concentrated solutions, and specifically to diluting allergenic solutions for sublingual allergy therapy.

2. Background Art

Conventionally, dilution of concentrated solutions is generally accomplished by adding concentrated solution to a diluent solution. Conventional methods of dilution vary as to whether the concentrated solution is added to the diluent or the diluent is added to the concentrate. Conventional dilution systems may use a wide variety of containers and extraction equipment to mix and remove the diluent and the concentrate including vials, syringes, beakers, and graduated cylinders.

Conventional dilution systems involving small containers, such as vials, often are challenging to use during the dilution process because the small size of the container makes it prone to tipping over. When the container tips over, at best, the effect is merely annoying; however, at worst, the diluted solution being created may spill out and be rendered completely unusable.

SUMMARY

Aspects of this document relate to dilution kits and methods that improve the ease of use of small containers, such as vials. These aspects may comprise, and implementations may include, one or more or all of the components and steps set forth in the appended CLAIMS, which are hereby incorporated by reference.

In one aspect, a dilution kit is disclosed. A dilution kit for and a method of diluting concentrated solutions used to treat allergic symptoms are disclosed. The dilution kit may comprise a case comprising: a base; and a cover hingedly coupled to the base. A foam pad may be removably coupled within the base, the foam pad defining a plurality of vial apertures. A plurality of vials may be removably positionable within the plurality of vial apertures.

Particular implementations may include one or more or all of the following.

The plurality of apertures in the foam padding may be smaller than the plurality of vials. The plurality of apertures may be one of a same size, a different size, and a combination thereof. An o-ring seal may be provided in a groove along a circumferential edge of the base. The cover may comprise at least one latch that allows the cover to removably couple to the base. The base and the cover may each comprise an aligning locking member. The plurality of vials may be inserted in a specified order in the plurality of apertures corresponding to a label marker on the vials left to right and top to bottom.

In another aspect, a method of diluting concentrated solutions used to treat allergic symptoms is disclosed. The method may comprise the steps of: removably positioning at least one of a plurality of vials in an upwardly facing position within at least one of a plurality of apertures defined in a layer of foam padding in a base of a case of a dilution kit; and placing a predetermined amount of one of a diluent, a concentrated solution, and a combination thereof into at least one empty vial of the plurality of vials.

Particular implementations may include one or more or all of the following.

The step of removably positioning at least one of a plurality of vials may comprise rotating a top of the at least one vial upward while a bottom of the at least one vial remains in the at least one aperture.

The step of removably positioning at least one of a plurality of vials may comprise: removably positioning a concentrated solution vial in an upwardly facing position within a corresponding aperture; and removably positioning an empty final vial in an upwardly facing position within a corresponding aperture.

The step of placing a predetermined amount of one of a diluent, a concentrated solution, and a combination thereof into at least one empty vial may comprise: removing a predetermined amount of concentrated solution from the concentrated solution vial and placing the predetermined amount concentrated solution into the empty final vial.

The method may further comprise: removably positioning a diluent vial in an upwardly facing position within a corresponding aperture; removably positioning at least one empty intermediate vial in an upwardly facing position within a corresponding aperture; removably positioning an empty start vial in an upwardly facing position within a corresponding aperture; removing a predetermined amount of diluent from the diluent vial and placing a portion of the predetermined amount of diluent into each of the at least one empty intermediate vial and the empty start vial; removing a predetermined amount of concentrated solution from the final vial and placing the predetermined amount of concentrated solution into the at least one intermediate vial; and removing a predetermined amount of a solution from the at least one intermediate vial and placing the predetermined amount of solution into the start vial.

The method may further comprise: placing the plurality of vials in a specified order left to right and top to bottom in the plurality of apertures corresponding to a label marker on the vials; inserting dropper tips into predetermined vials; nestling the plurality of vials into their corresponding apertures and removably latching a cover of the case to the base; and/or locking the cover to the base to prevent unauthorized access.

The foregoing and other aspects and implementations of dilution kits and related methods may have one or more or all of the following advantages.

Because all of the vials used to make a solution may be held upwardly facing in an aperture in a layer of foam padding during dilution, the potential for spillage and loss of solution is greatly reduced.

Placing completed vials containing diluted solution into a kit allows a patient for example to conveniently carry and transport the kit while treatments are ongoing.

The foregoing and other aspects, features, and advantages will be apparent to those of ordinary skill in the art from the DESCRIPTION and DRAWINGS, and from the CLAIMS.

BRIEF DESCRIPTION OF THE DRAWINGS

Implementations will hereinafter be described in conjunction with the appended DRAWINGS (which are not necessarily to scale), where like designations denote like elements, and.

DESCRIPTION

This document features dilution kits for and methods of diluting concentrated solutions used, for example, to treat allergic symptoms. There are many features of dilution kits and methods disclosed herein, of which one, a plurality, or all features may be used in any particular implementation.

In the following description, reference is made to the accompanying DRAWINGS which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure.

Accordingly, there are a variety of dilution kit implementations. Notwithstanding, turning to FIGS. 1-3 and for the exemplary purposes of this disclosure, dilution kit 10 is shown.

Figure 1:
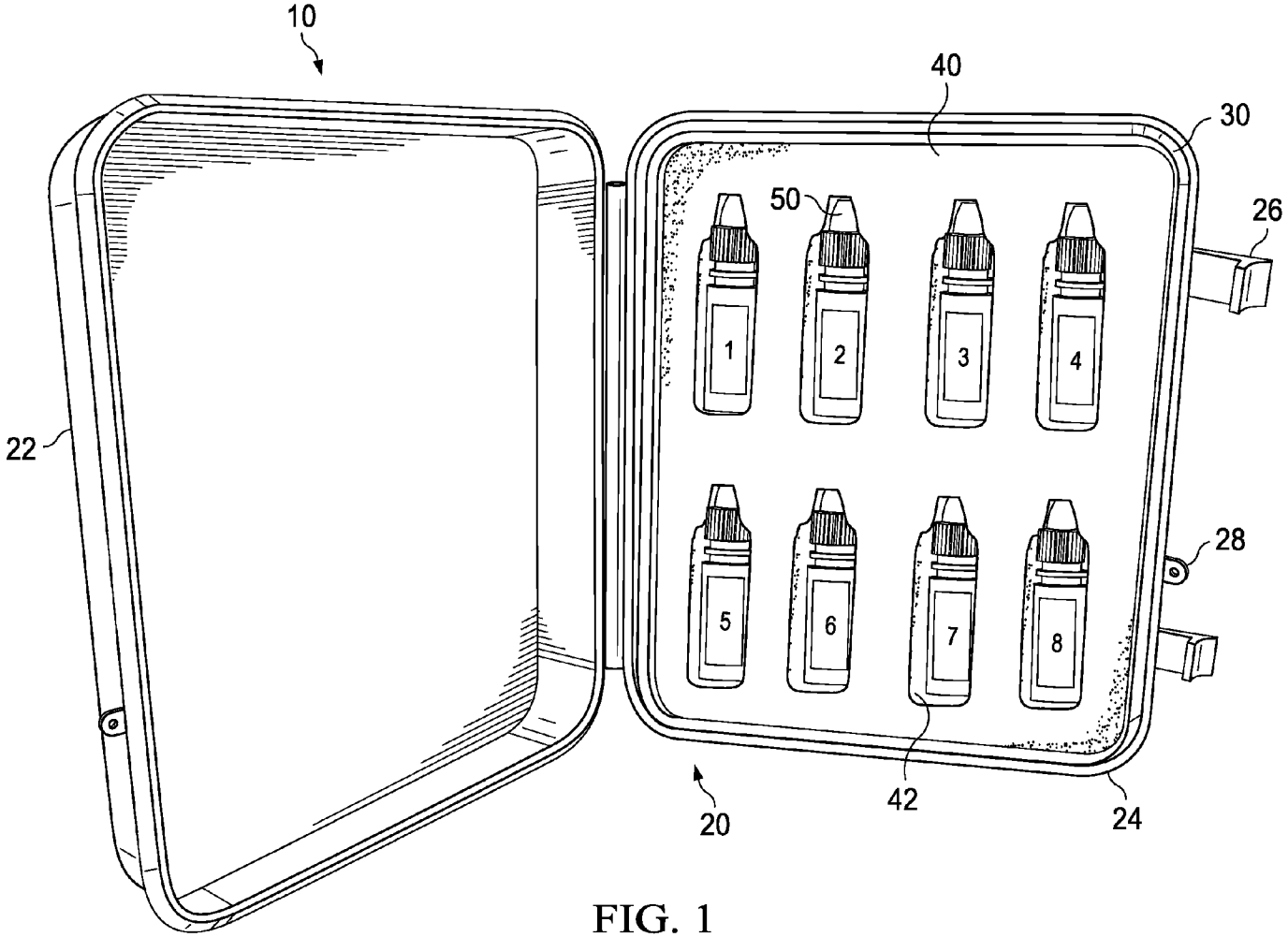
FIG. 1 is a front perspective view of an implementation of a dilution kit.

Referring to FIG. 1, dilution kit 10 is illustrated in an assembled condition. Dilution kit 10 includes a plurality of openings or apertures 42 in foam padding 40 sized to receive a plurality of vials 50. The openings or apertures 42 in foam padding 42 may be slightly smaller than the vials 50. Such a smaller size and the material characteristics of the foam padding itself (e.g., its resiliency, conformity, and the like) maintain the vials with a snug fit not only in a horizontal position entirely within the apertures 42, but in any angular or vertical position with the top of the vials 50 out of the apertures 42 and the bottom of the vials 50 within the apertures 42. Obviously, a different padding could be used that includes similar material characteristics as foam padding.

The foam padding 42 is removably coupled into a base 24 of case or housing 20 which includes an o-ring seal 30 in a groove along its edge. A cover 22 of case or housing 20 is included that is hingedly coupled to base 24 and includes latches 26 that allow cover 22 to latch over base 24. Aligned locking members 28 are included on cover 22 and base 24 and are configured to allow for insertion of a locking device through apertures in locking members 28.

Figure 2:
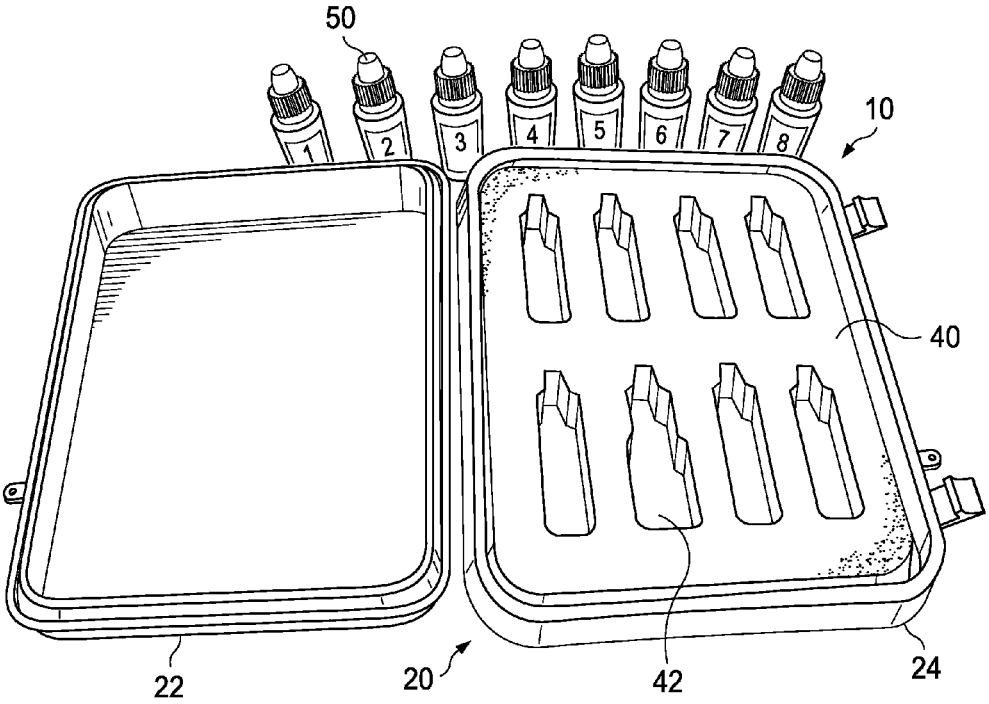
FIGS. 2-3 are top perspective views of the dilution kit implementation illustrated in FIG. 1 during use.

Turning to FIG. 2, dilution kit 10 is illustrated in a disassembled condition. Foam padding 40 could comprise two layers, a top layer having apertures 42 sized to receive each of the vials 50 and a bottom layer (not shown) that fits into base 24 below the top layer. Openings or apertures 42 may be all the same size, all different in size, or contain any combination and/or arrangement of similarly/dissimilarly sized apertures depending in part on the vials 50 used.

Many additional implementations are possible. Further implementations are within the CLAIMS.

It will be understood that dilution kit implementations are not limited to the specific assemblies, devices and components disclosed in this document, as virtually any assemblies, devices and components consistent with the intended operation of a dilution kit implementation may be utilized. Accordingly, for example, although particular assemblies, devices and components are disclosed, such may comprise any shape, size, style, type, model, version, class, measurement, concentration, material, weight, quantity, and/or the like consistent with the intended operation of a dilution kit implementation. Implementations are not limited to uses of any specific assemblies, devices and components; provided that the assemblies, devices and components selected are consistent with the intended operation of a dilution kit implementation.

Implementations of dilution kits and components may be formed of any of many different types of materials or combinations thereof that can readily be formed into shaped objects provided that the materials selected are consistent with the intended operation of a dilution kit implementation. For example, the components may be formed of: rubbers (synthetic and/or natural) and/or other like materials; polymers such as thermoplastics (such as ABS, Fluoropolymers, Polyacetal, Polyamide; Polycarbonate, Polyethylene, Polypropylene (low or high density), Polysulfone, and/or the like), thermosets (such as Epoxy, Phenolic Resin, Polyimide, Polyurethane, Silicone, and/or the like), any combination thereof, and/or other like materials; carbon-fiber, aramid-fiber, any combination thereof, and/or other like materials; composites and/or other like materials; metals; alloys; any other suitable material; and/or any combination of the foregoing thereof.

Various dilution kit implementations may be manufactured using conventional procedures as added to and improved upon through the procedures described here. Some components defining dilution kit implementations may be manufactured simultaneously and integrally joined with one another, while other components may be purchased pre-manufactured or manufactured separately and then assembled with the integral components. Accordingly, manufacture of these components separately or simultaneously may involve vacuum forming, injection molding, blow molding, casting, forging, cold rolling, milling, drilling, reaming, turning, grinding, stamping, pressing, cutting, bending, welding, soldering, hardening, riveting, punching, plating, and/or the like. Components manufactured separately may then be coupled or removably coupled with the other integral components, if necessary, in any manner, such as with adhesive, a weld joint, a solder joint, a fastener (e.g. a bolt and a nut, a screw, a rivet, a pin, and/or the like), washers, retainers, wrapping, wiring, any combination thereof, and/or the like for example, depending on, among other considerations, the particular material forming the components.

Thus, for the exemplary purposes of this disclosure, turning to FIGS. 1 and 2 again, dilution kit 10 may be assembled by placing a layer of foam padding 40 having apertures 42 into the base 24. Optionally, if included, a different layer of foam padding may be placed below foam padding 40. Regardless, then vials 50 may be inserted into apertures 42 in the layer of foam padding 40. In particular implementations, the vials 50 may be inserted in a specified order corresponding to a label marker on the vial. For example, a vial may have a label marker of "#1", and may be placed in the topmost left aperture in the layer of foam padding 40, and the next vial with a label marker of "#2" may be placed in the aperture immediately to the right. This process may be repeated for the remaining vials, moving left to right, top to bottom.

Dilution kit implementations may be used with similar results in a variety of applications. In general and for the exemplary purposes of this disclosure, dilution kit 10 may be used to dilute concentrated solutions through execution of the following steps. An empty vial 50 may be placed in an upwardly facing position within one of the apertures 42 in the layer of foam padding 40 for support during the dilution process. For example, this may be accomplished by rotating the top of the vial 50 upward while the bottom of the vial 50 remains in the aperture 42. Next, the cap of the vial 50 may be removed. Diluent may then be placed into the vial 50, followed by concentrated solution. Because the vial 50 being filled is being held in the upwardly facing position within an aperture 42 in the foam padding 40, it is not free to rotate or fall over. Accordingly, the probability that the vial 50 will overturn and spill its contents is dramatically reduced.

Figure 3:
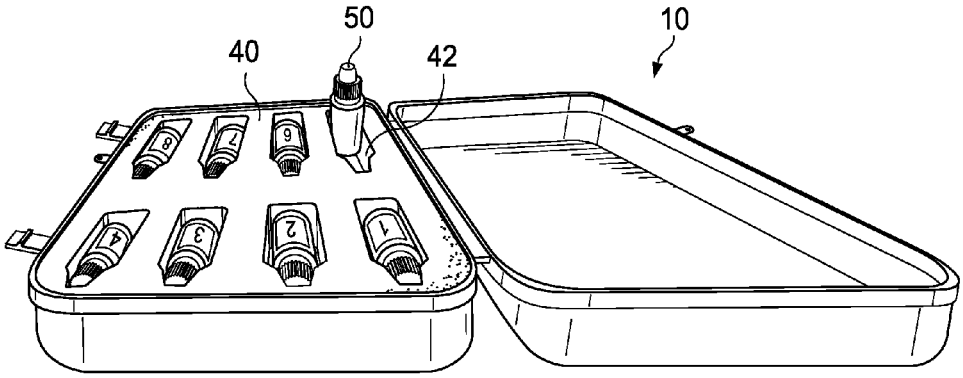

Describing the use of dilution kit implementations further and for the exemplary purposes of this disclosure, dilution kit 10 may be used to dilute serum used to treat allergic symptoms. Turning to FIG. 3, a user (such as a prescribing doctor or even a technician for example) may open the cover 22 of case 20. Any vials 50 present in the apertures 42 in the layer of foam padding 40 may be removed. Alternatively, vials 50 may remain in the apertures 42 in the layer of foam padding 40, and as appropriate, the particular empty vial 50 to be addressed may be placed in an upwardly facing position within its aperture 42 in the layer of foam padding 40 as needed for support during the dilution process (e.g., by rotating to top of the vial 50 upward while the bottom of the vial 50 remains in the aperture 42 as depicted in FIG. 3).

According to some embodiments, apertures 42 are located directly in a tray and not in foam padding. The tray is made of any of the materials as discussed above, such as thermoplastics, chipboard, resin, or the like. According to a particular embodiment, the tray comprises a chipboard material with a foam insert. In other embodiments, a foam insert is not provided. In one embodiment, apertures 42 in the tray are sized to substantially fit the size of one or more vials 50. In another embodiment, the tray may comprise an opening to substantially fit the size of one or more vials 50. Although in the discussed method, particular vials 50 are discussed as being placed in particular apertures 42, embodiments contemplate any vial 50 being placed in any aperture 42 or in any order in apertures 42, which are sized to fit or sized larger than the circumference of any vial 50. In addition, or as an alternative, the tray and/or apertures 42 may be any size, shape or configuration, according to particular needs. In other embodiments, one or more vials 50 may be placed on any surface without the use of apertures and according to the order as described herein.

The one or more vials 50 are preferably sized as a small vial with a 6 mL capacity, a large vial with a 13 mL capacity, and/or a metered dose vial with a 15 mL capacity. A small vial is particularly advantageous to comprise each "ramping up" solution, which includes any vial with a concentration less than the concentration in the maintenance vial. A large vial is particularly advantageous to comprise each maintenance, serum, diluent, or final solution. A metered dose vial is particularly advantageous to comprise a maintenance solution. Although the one or more vials 50 are mentioned as having particular capacities or containing particular solutions, any vial 50 may be in any suitable capacity or contain any suitable solution, as discussed herein.

According to some embodiments, the number of apertures 42 is equal to one or more sets of vials 50. As will be explained below, vials 50 are filled with various aqueous dilutions of a serum. According to embodiments where the number of apertures is equal to a single set of vials, one set of dilutions is filled in one application of the method. According to embodiments, where the number of apertures is equal to a multiple of a set of vials, multiple dilutions may be performed simultaneously. According to some embodiments, a tray comprises multiple sets of apertures 42 for each of the diluted serum vials and only one aperture 42 for each of the Serum vial 50, Diluent vial 50, the Final vial 50, or any one or more of the vials 50 mentioned further herein. In addition, or as an alternative, a single set of vials or a multiple set of vials may be placed in a tray or on a surface according to particular needs.

Thus, for the exemplary purposes of this disclosure, a vial 50 labeled "Diluent" for example may be placed in an upwardly facing position in the topmost left hand aperture 42, a tray comprising any slots, open areas, or apertures or on any surface. Although a particular placement is described for exemplary purposes, the placement of vial 50 or any of the vials 50 may be positioned according to particular needs.

According to some embodiments, the vial 50 labeled "Diluent" comprises a diluent comprising a glycerin solution. According to some embodiments, the glycerin solution is a 50% glycerin solution or a 10% glycerin solution. A 50% glycerin solution comprises 50% v/v glycerin, 0.091% sodium bicarbonate, 0.166% sodium chloride, and water sufficient to reach a 50% aqueous solution. A 10% glycerin solution comprises 10% v/v glycerin, 0.9% sodium chloride, 0.4% phenol, and water sufficient to reach a 10% aqueous solution. According to embodiments where the dilution kit is used to dilute serum, a 10% glycerin solution is particularly advantageous for injectable dilute serum because the 50% glycerin solution causes pain in some individuals. In addition, or as an alternative, a 50% glycerin solution is particularly advantageous for individuals with a sensitivity to phenol, which the 10% glycerin solution may comprise. Furthermore, the 50% glycerin solution is particularly advantageous for oral administration of the diluted serum as discovered it is better tolerated by patients. Other appropriate diluents may be substituted as one having skill in the art would recognize from this disclosure. By way of non-limiting example, any pharmacologically safe diluent comprising a stabilizer may be used.

Next, a vial 50 is placed, (e.g., 50 cc vial) labeled "Start-Up Serum" for example upwardly facing in the aperture, tray or surface, immediately to the right of the Diluents vial 50 in the topmost left hand aperture 42. In addition, as discussed above, the placement of vial 50 or any of the vials 50 may be positioned according to particular needs. According to some embodiments, the vial labeled "Start-Up Serum" comprises an allergenic extract. According to some embodiments, the allergenic extract comprises an allergen or dried material extract in solution at between 1:100 and 1:2 w/v. According to some embodiments, dried material is extracted at between approximately 1:20 to 1:1 w/v. Some extracts may be prepared by, for example, total mixture, i.e. by blending, of a 1:1 w/v of the whole or a portion of the allergen or v/v of a slurry prepared from the allergen with extracting fluid. According to a preferred embodiment, each extract is prepared to a 1:20 w/v glycerinated solution of a substance.

Similarly, a vial 50 is placed, labeled "Final" for example upwardly facing in the aperture immediately to the right of the Serum vial 50. Likewise, a vial 50 is placed, labeled "#2" for example upwardly facing in the aperture immediately to the right of the Final vial 50 (i.e., in FIG. 3, the last aperture 42 in the top row of apertures 42, or in a tray comprising any slots, open areas, or apertures or on any surface). Next, a user may place a vial 50 labeled "#1" for example upwardly facing in the aperture 42 below the #2 vial 50 in the right most aperture 42 in the bottom row of apertures or in a tray comprising any slots, open areas, or apertures or on any surface.

According to one particular dilution method, a 10 cc syringe may be used, for example, and remove 10 cc from the Serum vial 50 and placed into the Final vial 50. Then, the syringe may remove 8 cc from the Diluent vial 50 and place 4 cc of diluent into both the #2 vial 50 and the #1 vial 50. Next, the syringe may remove 1 cc of serum from the Final vial 50 and place it into the #2 vial. The #2 vial 50 may then be removed, shaken and then replaced upwardly facing into the aperture 42, or into a tray comprising any slots, open areas, or apertures or onto any surface, from which it came. According to some embodiments, the vial 50 is not shaken, but is instead mixed by a gentle rolling motion. Then, the syringe may remove 1 cc of solution from the #2 vial and place it into the #1 vial, upon which the #1 vial may be removed, shaken and then replaced upwardly facing into the aperture 42, or into a tray comprising any slots, open areas, or apertures or onto any surface, from which it came. According to some embodiments, the vial 50 is not shaken, but is instead mixed by a gentle rolling motion.

According to some embodiments, one or more vials 50 may be placed, labeled according to TABLE 1 into one or more apertures 42 any slots, open areas, or apertures of a tray or any surface.

TABLE 1

| Vial | Concentration (v:v) |
|---|---|
| Stock Serum | 1:100 |
| 1 (Maintenance) | 1:500 |
| 2 | 1:2500 |
| 3 | 1:12,500 |
| 4 | 1:62,500 |
| 5 | 1:312,500 |
| 6 | 1:1,562,500 |
| 7 | 1:7,812,500 |
| 8 | 1:39,062,500 |
| 9 | 1:195,312,500 |
| 10 | 1:976,562,500 |

According to some embodiments, the vials 50 are placed in an order comprising a #1 vial 50 next to a #2 vial 50, a #2 vial 50 next to a #3 vial 50 and so forth and then the remaining vials 50 are placed in numerical order. As can be seen in TABLE 1, an increasing number of vials 50 correlates with an increasingly dilute solution. For example, a maintenance vial 50 (vial #1) contains 1:500 dilution and a #10 vial contains 1:976,562,500 dilution. As will be explained below, when treating an allergy sensitivity, a user typically begins a treatment with a vial #8. However, more dilute solutions such as #9 and #10, which are particularly safe, are used with patients with particularly sensitive conditions such as, for example, infants, children under 4, patients with asthma (including brittle asthma), and the like. According to some embodiments, patients are given less dilute dilutions to begin treatment. For example, according to the concentrations listed in TABLE 1, a particularly advantageous treatment for sublingual immunotherapy for children comprises 4 drops daily of vial #3 for a child of 0-12 months, 4 drops daily of vial #2 for a child of 12-36 months, 2 drops daily of vial #1 for a child of 3-6 years, and 3 drops daily of vial #1 for a child of 7 years to any age greater than 7 years old.

By way of example only and not by way of limitation, the vials 50 listed in TABLE 1 are exemplary and found to have a particularly advantageous safety profile for nearly every patient to be treated with sublingual immunotherapy. According to some embodiments, the vials 50 of the dilution may comprise other concentrations as explained herein. For example, a first vial comprises between 1:20 and 1:500 w/v or v/v solution; a second vial comprises between 1:40 and 1:5000 solution, a third vial comprises between 1:80 and 1:50,000 solution; a fourth vial comprises between 1:160 and 1:500,000 solution; a fifth vial comprises between 1:320 and 1:5,000,000 solution, a sixth vial comprises between 1:640 and 1:50,000,000 solution, a seventh vial comprises between 1:1,280 and 1:500,000,000 solution, and an eighth vial comprises between 1:2,560 and 1:5,000,000,000 solution. In some embodiments, other dilutions or concentrations may be prepared based on the sensitivity of a patient to any particular allergen to be treated. Also, any number of vials or concentrations may be used. For example, for a particularly severe allergy, a user may start on a lower concentration of solution than a user with a less severe allergy. In other embodiments, a final concentration of 1:39,000,000 for the eighth vial was found to be particularly safe and effective. In yet other embodiments, a final concentration for the first vial of approximately 1:20 to approximately 1:500 was found to be particularly safe and effective.

Based on the exemplary concentrations in TABLE 1 of each vial given above, a patient performs the following exemplary regimen:

TABLE 2

| Day | # of Drops |
|---|---|
| 1 | 2 |
| 2 | 3 |
| 3 | 3 |
| 4 | 4 |
| 5 | 4 |
| 6 | 5 |
| 7 | 6 |
| 8 | 7 |
| 9 | 8 |
| 10 | 9 |

A user in some embodiments performs the regimen of TABLE 2 for every ten days for each vial, beginning at the eighth vial and ending at the second vial.

TABLE 3

| Day | # of Drops |
|---|---|
| 71 | 1 |
| 72 | 1 |
| 73 | 1 |
| 74 | 1 |
| 75 | 1 |
| 76 | 1 |
| 77 | 1 |
| 78 | 2 |
| 79 | 2 |
| 80 | 2 |
| 81 | 2 |
| 82 | 2 |
| 83 | 2 |
| 84 | 2 |
| 85 | 3 |
| 86 | 3 |
| 87 | 3 |
| 88 | 3 |
| 89 | 3 |
| 90 | 3 |

In some embodiments, a user then performs the regimen of TABLE 3 for each day 71 through 90 using the first vial. Thereafter, a user, in some embodiments, continues to take between 1 and 5 drops of the concentration of the first vial for three to five years to maintain prevention of an allergic response. In some embodiments, the dosage may be decreased or increased, or the amount of time spent using the concentration of any one or more vial may be increased or decreased based on, for example, the severity of an allergy.

In some embodiments, the dilution step is performed prior to preparation of the kit, so that individual vials are already prepared with a solution comprising various concentrations. In some embodiments, the kit comprises written material providing instruction to, for example, administer sub-lingual drops or provide a dilution of the concentrated composition. In some embodiments, the kit comprises a chart or calendar that permits a user to keep track of compliance with a regimen.

Those of ordinary skill in the art will be able to readily select manufacturing equipment and pharmaceutically acceptable additives or inert ingredients to manufacture embodiments of the dilution. For the exemplary purposes of this disclosure, some examples of pharmaceutically acceptable additives or inert ingredients and manufacturing process are included below. Notwithstanding the specific examples given, it will be understood that those of ordinary skill in the art will readily appreciate how to manufacture embodiments of the dilution according to this embodiment according to the other methods of administration and delivery disclosed in this document.

Accordingly, solutions diluted according to this method may include an acceptable additive (e.g. one of a solubilizer, an enzyme inhibiting agent, an anticoagulant, an antifoaming agent, an antioxidant, a coloring agent, a coolant, a cryoprotectant, a hydrogen bonding agent, a flavoring agent, a plasticizer, a preservative, a sweetener, a thickener, and combinations thereof) and/or an acceptable carrier (e.g. one of an excipient, a lubricant, a binder, a disintegrator, a diluent, an extender, a solvent, a suspending agent, a dissolution aid, an isotonization agent, a buffering agent, a soothing agent, an amphipathic lipid delivery system, and combinations thereof).

The dilutions according to TABLE 1 are dilutions based on each vial 50 comprising 20% of the concentration of the preceding vial 50. Other dilution regimens could be set up with each vial 50 comprising between approximately 5% and 95% of the concentration of the preceding vial. According to some embodiments, the solution in a vial is between approximately 10% and 20% of the preceding vial, between approximately 20% and 30% of the preceding vial, between approximately 30% and 40% of the preceding vial, between approximately 40% and 50% of the preceding vial, between approximately 50% and 60% of the preceding vial, between approximately 60% and 70% of the preceding vial, between approximately 70% and 80% of the preceding vial, and between approximately 80% and 90% of the preceding vial, wherein approximately suggests a range of preferably plus or minus 5-10% or within the standard of error of the particular syringe, pipette, micropipette or other suitable tool being used to measure the liquid amounts.

According to some embodiments, one or more sets of vials 50 may be placed into a tray comprising any slots, open areas, or apertures or onto any surface. For example, a first row of the tray comprises slots, open areas, or aperture 42 for each vial 50 in a first dilution, a second row of the tray comprises slots, open areas, or aperture 42 for each vial 50 in a second dilution, a third row of the tray comprises slots, open areas, or aperture 42 for each vial 50 in a third dilution, and so forth until each vial 50 being filled is placed in an appropriate slots, open areas, or aperture 42 of the tray or any surface.

Next, for a 20% or 1:5 dilution as illustrated in TABLE 1, 4 cc of diluent is placed into each of the vials 50 of the first, second, third and/or more or fewer multiples of sets of the dilution. For a 40% or 2:5 dilution, 3 cc of diluent is placed into each of the vials 50 of the first, second, third and/or further or less multiples of sets of the dilution. Further dilutions may be performed using appropriate amounts of diluent and serum, according to particular needs.

Continuing with the example of the 20% or 1:5 dilution, 2 cc of serum and 8 cc of diluent is placed into the first (or maintenance) vial 50 of each of the one or more sets. The solution in the first or maintenance vial 50 of each of the one or more sets is mixed by an appropriate mixing method, such as shaking, stirring, gently rolling, sonication, or the like. According to some embodiments, the solution in the first (or maintenance) vial 50 of each of the one or more sets is used as a sublingual immunotherapy solution. According to this example, the maintenance vial 50 is the final solution to be used in the immunotherapy treatment. As such, the amount of solution to be placed in the maintenance vial 50 is required to be more than the other vials 50 in the dilution set. Accordingly, in these embodiments and for making a 20% or 1:5 dilution, 8 cc of diluent is placed into the first (or maintenance) vial 50 and then 2 cc of serum is placed into the vial 50. The solution in the first (or maintenance) vial 50 of each of the one or more sets is mixed by an appropriate mixing method, and the method continues as explained below. Additionally, according to some embodiments, the concentration of the first (or maintenance) vial 50 is too strong for patients with particular sensitivities, as discussed above. For these patients, the second, third, fourth, or fifth vial 50 may be used as a maintenance vial 50. For these dilutions and for making a 20% or 1:5 dilution, the dilution would be prepared as explained below, and the patient would use a lower concentration vial as the maintenance vial.

After the maintenance vial 50 has been filled, 1 cc of the solution of the maintenance vial 50 is placed in the next vial 50 with 4 cc of diluent. The solution in the next vial 50 of the one or more sets is mixed by an appropriate mixing method. For the 1:5 dilution, the method continues until all vials 50 have been filled with 4 cc diluent and 1 cc solution of the preceding vial 50 of greater concentration.

Finally, dropper tips may be inserted, into, for example the appropriate vials 50. All vials 50 may then be nestled flat into their corresponding apertures 42 and the cover 22 coupled to base 24 by latches 26. Cover 22 may further be locked to base 24 using locking members 28 and a locking device to prevent unauthorized access.

For the exemplary purposes of this disclosure, oral delivery may be a particularly advantageous delivery route for administration to humans and animals of embodiments of a food composition, possibly formulated with appropriate additives to facilitate administration. Although drop size varies according to dropper design, bottle lot, and/or squeeze pressure, an ideal drop is between 0.03 mL and 0.07 mL, and more particularly 0.05 mL. In some embodiments, drop size is between approximately 0.01 mL and 0.1 mL.

Figure 4:
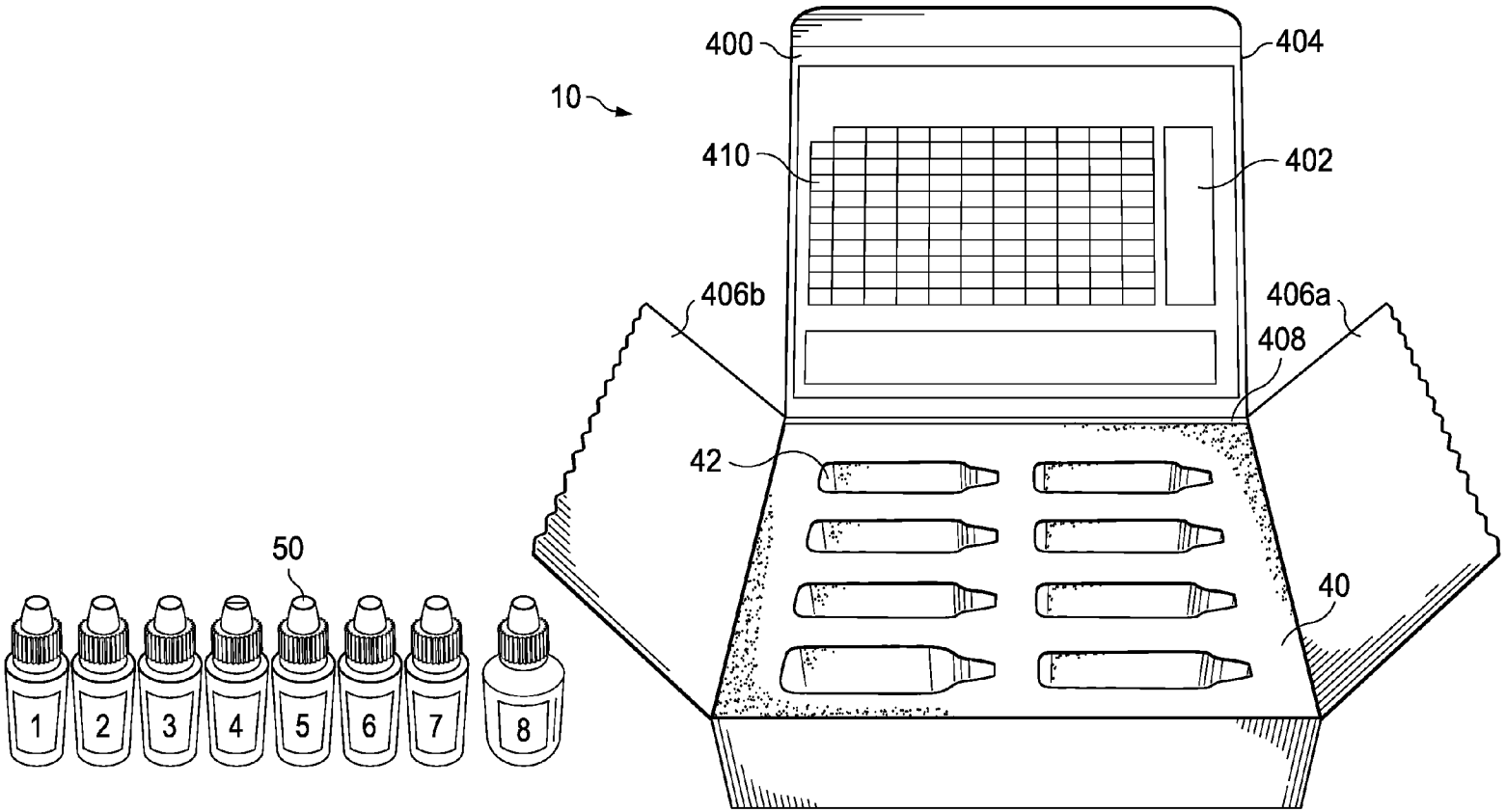
FIGS. 4-5 illustrate an exemplary dilution kit according to an embodiment.

FIG. 4 illustrates an exemplary dilution kit according to an embodiment. According to this embodiment, kit 10 comprises box 400, foam padding 40, apertures 42, vials 50, and instructions 402.

According to some embodiments, box 400 comprises a cardboard, chipboard, or other thin and semi-rigid packaging material. Although particular materials are described, any suitable material may be used. According to some embodiments, box 400 comprises lid 404, one or more flaps **406*a*-406*b*, and cavity 408. According to some embodiments, the lid comprises instructions 402, which may be adhered to the inside surface of lid 404 so that the instructions are easily readable when box 400** is in an opened position.

According to some embodiments, one or more flaps 406*a*-406*b* comprise surfaces that are substantially flat and are sized approximately half the width of cavity 408, such that when box 400 is closed the one or more flaps 406*a*0406*b* are placed between lid 404 and cavity 408.

According to some embodiments, cavity 408 comprises a space sized to fit foam padding 40 which may contain one or more apertures 42, as explained in more detail above. The apertures are sized according to vials 50, as is explained herein.

Figure 5:
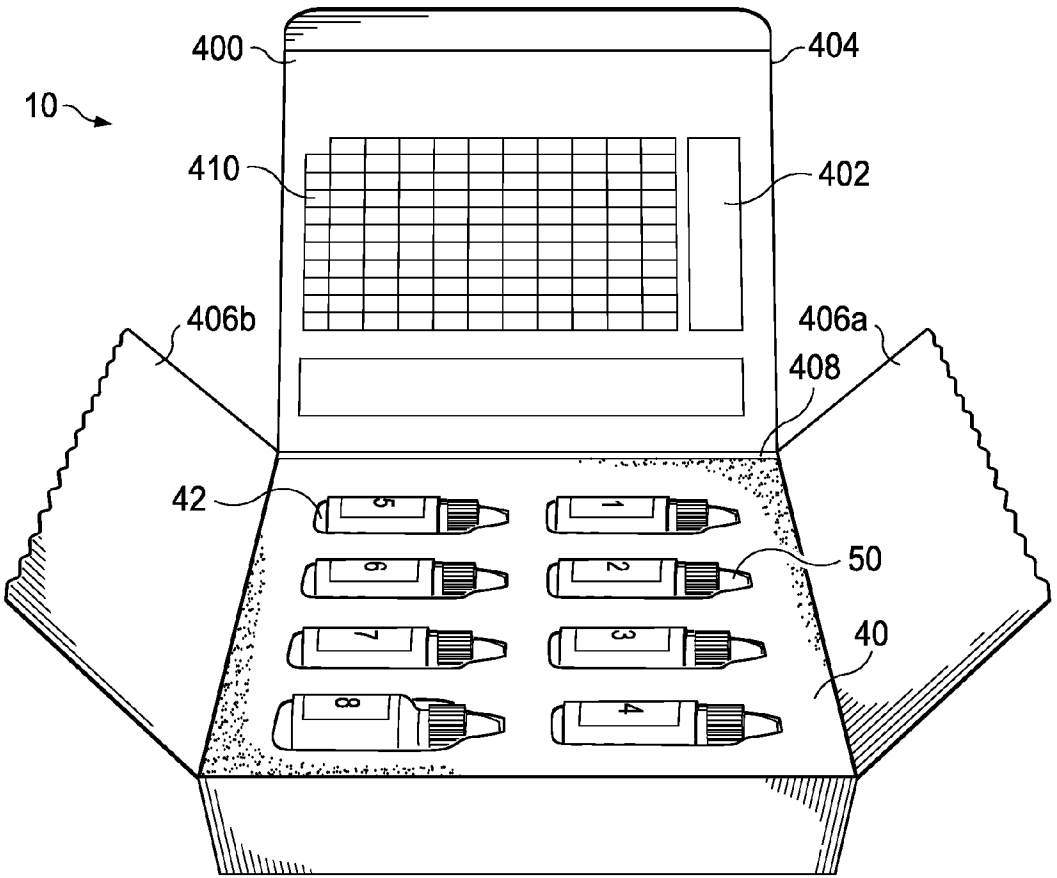

FIG. 5 illustrates the exemplary dilution kit of FIG. 4, according to a second embodiment. As illustrated, apertures 42 of foam padding 40 comprise one or more vials 50, which are secured in foam padding 40.

According to this embodiment, vials 50 may be securely packaged and shipped in a lightweight, user-friendly container, which is suitable for home or office use. As can be seen on instructions 402, vials 50 are numbered and color-coded according to the information on instructions 402, such that a user can track the user's use of an appropriate vial 50 across one or more days. According to some embodiments, instructions 402 comprises check boxes 410 to permit a user to track use of vials 50 after each use, such that a user may indicate with a mark inside box 400 after the corresponding vial 50 has been used for a specific time interval, such as, for example, a day, week, month, or the like.

In places where the description above refers to particular implementations, it should be readily apparent that a number of modifications may be made without departing from the spirit thereof and that these implementations may be alternatively applied. The accompanying CLAIMS are intended to cover such modifications as would fall within the true spirit and scope of the disclosure set forth in this document. The presently disclosed implementations are, therefore, to be considered in all respects as illustrative and not restrictive, the scope of the disclosure being indicated by the appended CLAIMS rather than the foregoing DESCRIPTION. All changes that come within the meaning of and range of equivalency of the CLAIMS are intended to be embraced therein.

What is claimed is:

1. A method of diluting concentrated solutions used to treat allergic symptoms, the method comprising:

placing a predetermined amount of one of a diluent, a concentrated solution, and a combination thereof into at least one empty vial of a plurality of vials, the plurality of vials comprising an empty maintenance vial, a diluent vial, at least one empty intermediate vial and an empty start vial;

removing a predetermined amount of concentrated solution from a concentrated solution vial and placing the predetermined amount of concentrated solution from the concentrated solution vial into an empty maintenance vial;

removing a predetermined amount of diluent from a diluent vial and placing a portion of the predetermined amount of diluent from the diluent vial into each of the at least one empty intermediate vial and the empty start vial;

removing a predetermined amount of concentrated solution from the maintenance vial and placing the predetermined amount of concentrated solution from the maintenance vial into the at least one intermediate vial; and removing a predetermined amount of a solution from the at least one intermediate vial and placing the predetermined amount of solution from the at least one intermediate vial into the start vial.

2. The method of claim 1, wherein the ratio to a concentration of the solution in the intermediate vial to a concentration of the concentrated solution in the maintenance vial is 1:5.

3. The method of claim 1, wherein the ratio to a concentration of the solution in the intermediate vial to a concentration of the concentrated solution in the maintenance vial is one or more of approximately 20%, 30%, 40%, and 50%.

4. The method of claim 1, wherein the plurality of vials comprises multiple sets of vials.

5. The method of claim 1, wherein the plurality of vials are inserted in a specified order corresponding to a label marker on the vials.

* * * * *